US006206234B1

(12) United States Patent
Rawlins

(10) Patent No.: US 6,206,234 B1
(45) Date of Patent: Mar. 27, 2001

(54) CIGAR VENDING MACHINE

(75) Inventor: Mark Wayne Rawlins, Surrey (CA)

(73) Assignee: Slim Line Designs Ltd., British Columbia (CA)

( * ) Notice: Subject to any disclaimer, the term of this patent is extended or adjusted under 35 U.S.C. 154(b) by 0 days.

(21) Appl. No.: 09/200,765

(22) Filed: Nov. 27, 1998

(51) Int. Cl.[7] ..... G07F 11/00
(52) U.S. Cl. ..... 221/195; 221/123; 221/131
(58) Field of Search ..... 221/194, 191, 221/195, 123, 131

(56) References Cited

U.S. PATENT DOCUMENTS

| | | | | |
|---|---|---|---|---|
| D. 399,258 | | 10/1998 | Rawlins | D20/4 |
| 530,561 | * | 12/1894 | Thissell | 221/131 X |
| 962,825 | * | 6/1910 | Evans et al. | 221/122 |
| 2,311,632 | * | 2/1943 | Berger et al. | 221/241 |
| 3,254,792 | * | 6/1966 | Danielson et al. | 221/191 X |
| 3,757,998 | | 9/1973 | Millies et al. . | |
| 4,717,044 | * | 1/1988 | Suzuki et al. | 221/195 X |
| 4,867,628 | | 9/1989 | Ammon et al. . | |
| 5,971,205 | * | 10/1999 | Michaels et al. | 221/135 |

FOREIGN PATENT DOCUMENTS

| | | |
|---|---|---|
| 53670 | 9/1890 | (DE) . |
| 1238734 | 7/1971 | (GB) . |

* cited by examiner

*Primary Examiner*—Christopher P. Ellis
*Assistant Examiner*—Patrick Mackey
(74) *Attorney, Agent, or Firm*—Bull, Housser & Tupper

(57) ABSTRACT

A cigar vending machine for selectively dispensing cigars of varying sizes on selection by a user includes a plurality of cigar storage and dispensing containers each of which includes a base plate having an extension portion extending in a first direction, a restraining plate having an edge oriented in the first direction, the restraining plate in spaced, substantially parallel relationship with the base plate, the extension portion extending substantially in the first direction beyond the edge of the restraining plate. An adjuster is provided to adjust the distance between the base plate and restraining plate to conform to the diameter of cigars located between the base plate and restraining plate and an adjustable stop communicates with the extension for preventing movement of the cigars located between the base plate and restraining plate in the first direction, the stop adjustable along the plane of the base plate to change the distance between the stop and an edge plane perpendicular with the base plate and adjacent the edge of the restraining plate, to conform to the diameter of the cigar to be located adjacent the stop. A cigar dispenser moves the selected cigar adjacent the stop, past the stop upon activation by an activator to dispense the selected cigar, upon a selector receiving an input from a user to identify the selected cigar from one of the plurality of containers.

24 Claims, 5 Drawing Sheets

CIGAR VENDING MACHINE

BACKGROUND OF THE INVENTION

1. Field of the Invention

The present invention relates to a vending machine for selectively dispensing cigars of varying sizes on selection by a user.

2. Description of the Prior Art

Vending machine dispensing various products such as cigarettes and candy are well known in the art. One type of vending machine generally comprises a plurality of coils with food or other objects to be dispensed interposed between adjacent loops of a coil. The user can view the objects through a window of the vending machine and make a selection of desired product upon depositing sufficient funds into the machine. The product is dispensed when the coil of the selected product rotate one revolution which causes the object closest to the user to fall into a receptacle where it can be retrieved by the user.

Other types of vending machines such as those used for cigarettes, provide a series of trays within which the cigarette packages are stacked. The user may select an appropriate brand after depositing sufficient funds in the machine. This causes one package of the selected brand of cigarettes to be released into a receptacle for retrieval by a user.

These vending machines are suitable for dispensing objects which can readily fit within the loops of coils for dispensing or which are of substantially uniform size such as, for example, cigarette packages. Many types of cigars are sold one cigar at a time, rather than as packaged sets. Cigars come in various sizes, ranging in diameter from about ½ inch to 1 inch (or even larger) and ranging in length from about 3 inches to about 8 inches in length, for the most popular types. These prior art machines are not suitable for storing and dispensing single cigars of varying diameter and length.

The popularity of cigar smoking has increased considerably and vending machine access to a wide selection of singularly dispensed cigars of varying length and diameter is desired. There is consequently a need for a vending machine which can store and dispense cigars of varying diameter and length and which permits visual inspection of those cigars by a user to assist in selection and purchase of a desired cigar. There is also a need for such a vending machine which prevents the dispensing of more than one cigar at a time upon activation to prevent losses caused by inadvertent over dispensing of cigars.

BRIEF SUMMARY OF INVENTION

The present invention provides a cigar vending machine having several cigar storage and dispensing containers which are adjustable both vertically and horizontally to store and dispense a plurality of cigars of certain diameter. Each cigar storage and dispensing container permits the adjustment of the height of a restraining plate with respect to a base plate and the forward direction of a stop retaining the cigars in the containers against the force of gravity. A cigar dispenser is provided for each cigar storage and dispensing container to move the first cigar past the stop to dispense the cigar upon payment and selection by a user. The restraining plate ensures that each cigar is aligned in parallel alignment and an extension portion of the base plate allows the first cigar of a plurality of cigars to be exposed beyond an edge of the restraining plate to be dispensed upon activation of the cigar dispenser for that particular container. The other cigars are prevented from being dispensed on that cycle by the restraining plate spaced from the base plate generally an amount equal to the diameter of the particular cigars in that container.

A vending machine for selectively dispensing cigars of varying diameter includes a plurality of cigar storage and dispensing containers. Each of those containers include a base plate having an extension portion extending in a first direction, a restraining plate having an edge oriented in the first direction, an adjuster for adjusting the distance between the base plate and restraining plate to conform to the diameter of the cigars to be located between the base plate and restraining plate, an adjustable stop communicating with the extension for preventing movement of the cigars located between the base plate and restraining plate in the first direction and a cigar dispenser for moving the cigar adjacent the stop past the stop. The restraining plate is oriented in spaced, substantially parallel relationship with the base plate, for locating a plurality of cigars of equivalent diameter between the base plate and restraining plate. The extension portion extends substantially in the first direction beyond the edge of the restraining plate. The stop is adjustable along the plane of the base plate to change the distance between the stop and an edge plane perpendicular with the base plate and adjacent the edge of the restraining plate, to conform to the diameter of the cigar to be located adjacent the stop. A selector is provided for receiving an input from a user for selecting a particular cigar from one of the plurality of containers and an activator activates the cigar dispenser of the container containing the selected cigar to move that cigar past the stop to dispense the selected cigar.

The cigar dispenser may optionally comprise a finger extending from a rotatable arm, the finger contacting the cigar adjacent the stop and moving that cigar past the stop upon rotation of the rotatable arm. The extension portion can include a slot aligned with the finger located below the cigar adjacent the stop and the rotatable arm can rotate 180 degrees upon activation by the activator to move the cigar adjacent the stop past the stop. The finger may be a plurality of fingers and the slot may be a plurality of slots aligned with the plurality of fingers.

Optionally the adjuster may include biasing means for biasing the base plate away from the restraining plate and a plate stop preventing further movement of the base plate and restraining plate apart from each other, acting against the force of the biasing means.

The plurality of cigar storage and dispensing containers may optionally be oriented at an angle and the force of gravity is used to maintain the cigars located between the base plate and restraining plate against the stop. The force of gravity also advances the cigars towards the stop upon the cigar adjacent to the stop being moved past the stop to dispense that cigar.

As a further option the vending machine can include a pair of opposed adjustable end plates for aligning each end of the cigars, the end plates located between the base plate and restraining plate.

The restraining plate may optionally be clear permitting the cigars located between the base plate and restraining plate to be viewed.

DETAILED DESCRIPTION OF THE PREFERRED EMBODIMENT(S)

Figure 1:
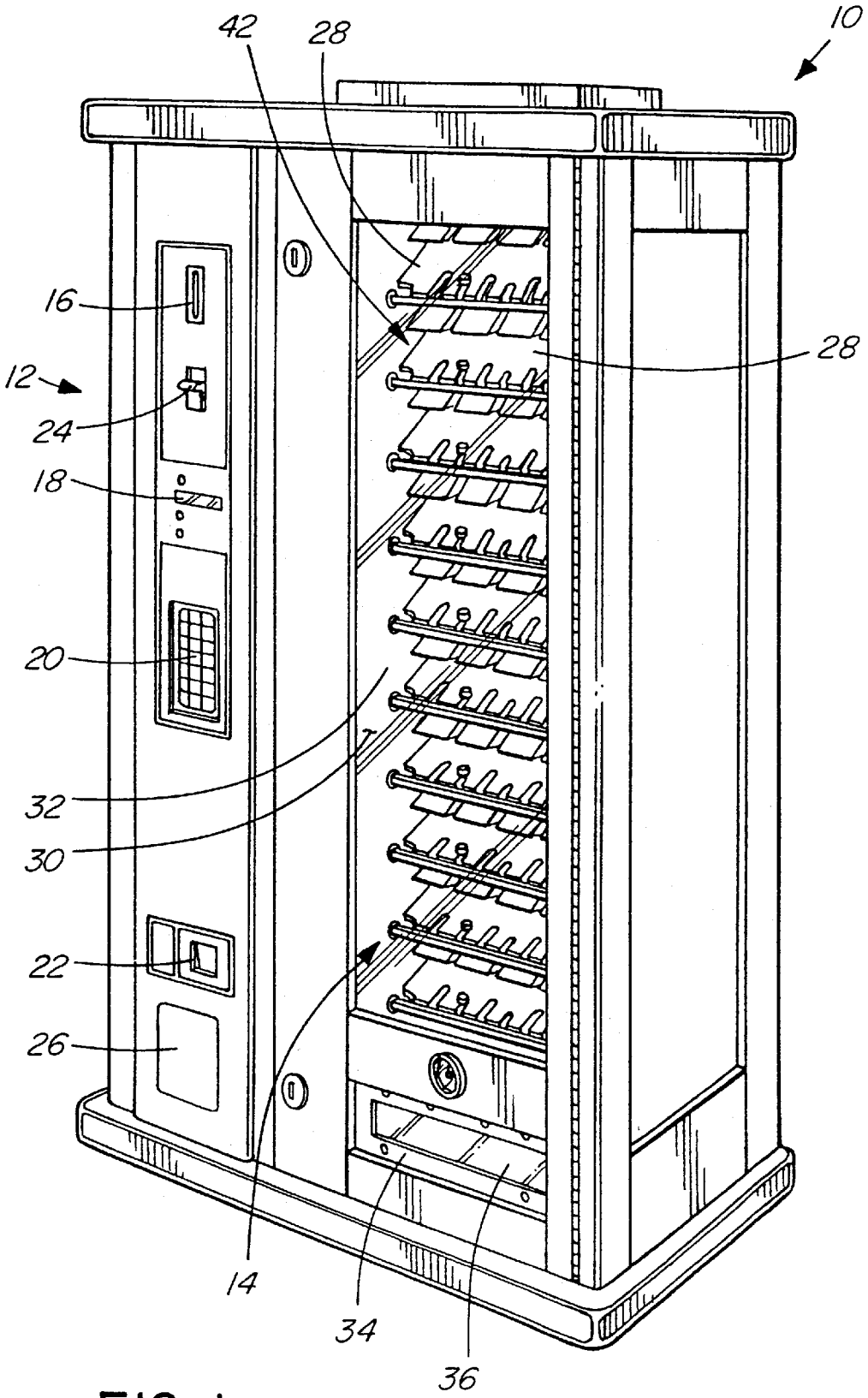
FIG. 1 is a perspective view of the vending machine of the present invention.

FIG. 1 is a perspective view of the cigar vending machine 10 of the present invention. Vending machine 10 includes vending section 12 and cigar storing and dispensing section 14.

Vending section 12 is typical of many vending machines and is well known in the art. Coins are deposited in coin slot 16 which are credited and shown in LED display 18. The user selects the desired cigar by depressing the appropriate keys on keypad 20 which activates the dispensing of that cigar as will be described below. Change can be retrieved at coin dispensing unit 22. Coins inserted by a user can be returned to that user prior to the selection of a cigar by depressing manual coin return lever 24 whereupon the coins will be returned in coin dispensing unit 22. Coin storage lock box 26 is used to store coins used to purchase cigars and may be readily retrieved using an appropriate key, by the vending machine operator.

Cigar storing and dispensing section 14 includes a plurality of cigar storage and dispensing containers 28. In the case of the preferred embodiment, and exemplary only, the plurality is thirteen. Containers 28 are aligned vertically with a single container 28 at each level. Window 30 covers the front area of section 14 allowing users to view cigars in each container 28 to facilitate the selection of the desired cigar by the user. At the same time the cigars in containers 28 remain secure within section 14, sealed off from the outside by window 30.

Once a cigar is selected and the appropriate container 28 activated to dispense a cigar, it drops by force of gravity along the front open section 32 (FIG. 5) of section 14 down to the bottom of section 14, adjacent door 34. The user can view the cigar through window 36 of door 34. User may push door 34 inwardly to manually retrieve the dispensed cigar as will be described more fully below.

Figure 2:
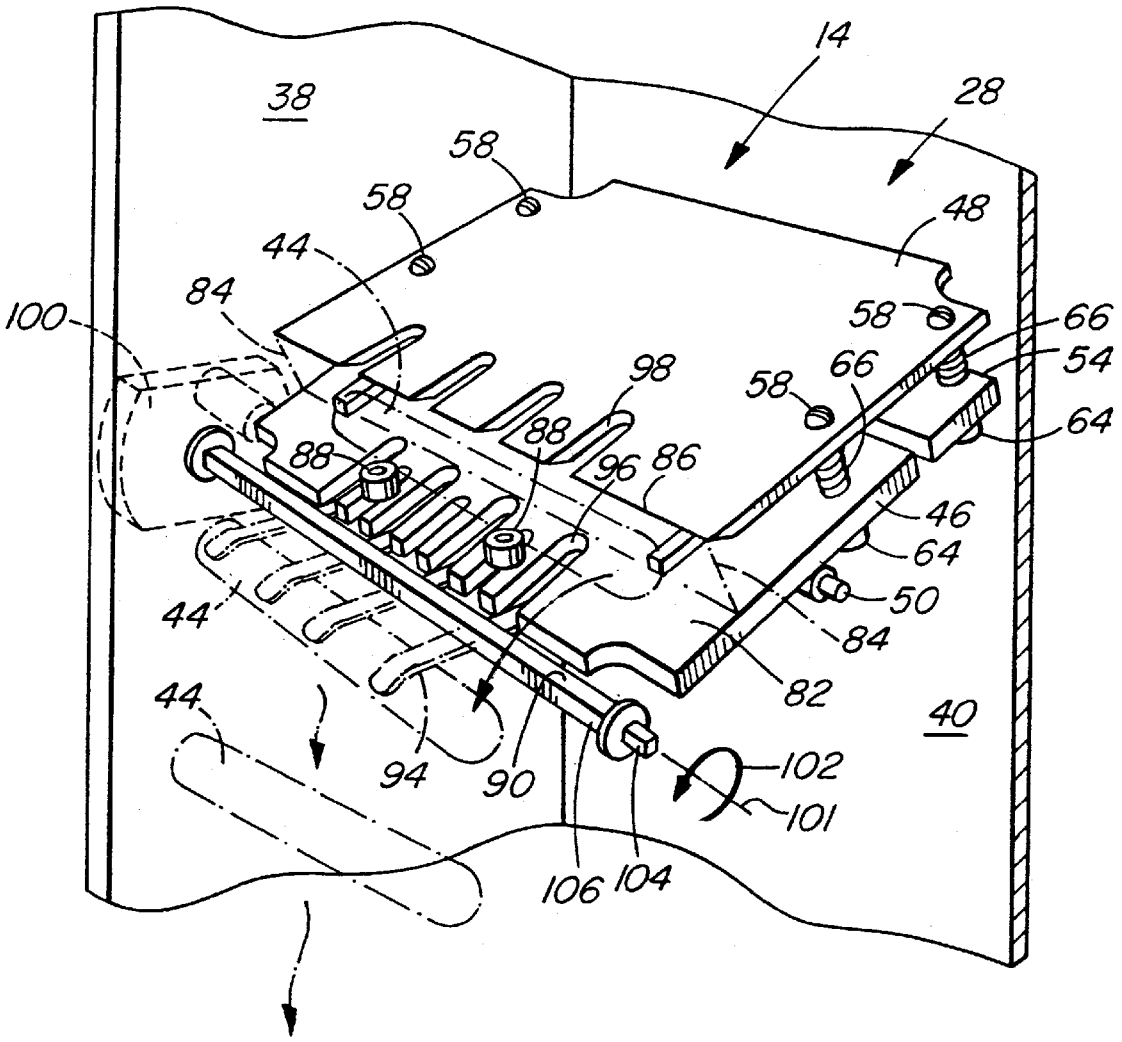
FIG. 2 is an isometric view of one cigar storage and dispensing container of the invention of FIG. 1.
Figure 3:
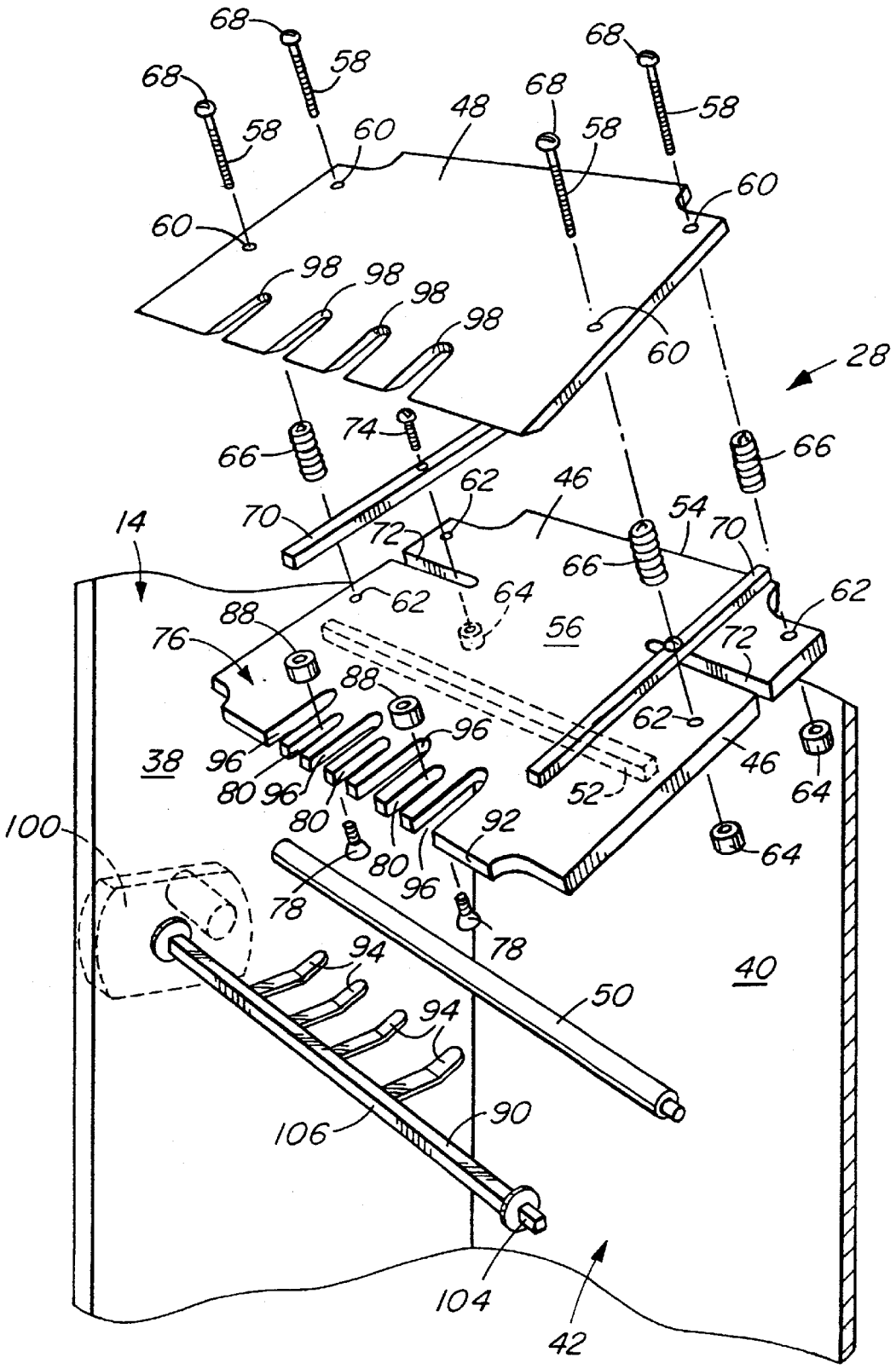
FIG. 3 is an exploded isometric view of the cigar storage and dispensing container of FIG. 2.

Referring to FIG. 2, one of the plurality of containers 28 is shown within section 14. FIG. 3 is essentially an exploded view of the container of FIG. 2. Section 14 includes left side wall 38, rear wall 40, right side wall 39 (FIG. 4) and window 30 at the front. These elements surround containers 28 forming cavity 42 therein. Cavity 42 includes containers 28 and front open section 32 (FIG. 5). Cavity 42 is sealed off from the outside when in use with the only outside access being through door 34 normally maintained in a closed position. Optionally cavity 42 may be operated as a humidor with appropriate humidity being maintained by a humidifier 25 (FIG. 5) in section 12.

As is best seen in FIG. 2, container 28 is orientated at an angle from the horizontal to permit the force of gravity to cause cigars 44 to fall downwardly as the first cigar in line, that is the closest cigar to window 30, is dispensed. Preferably the angle of container 28 from the horizontal is between 30 degrees and 45 degrees, and most preferably about 33 degrees.

Container 28 includes base plate 46 below and in spaced parallel alignment with restraining plate 48. Base plate 46 rests against support tube 50 aligned against flange 52, shown in FIG. 3. Rear edge 54 of plate 46 is angled inwardly from the top face 56 to the bottom face of plate 46 as seen best in FIG. 5, support tube 50 lies just below flange 52, and edge 54 contacts rear wall 40, to support containers 28 in place in spaced angled relationship with one another. Support tube 50 extends and is secured at its ends to left side wall 38 and right side wall 39 of section 14.

As seen best in FIG. 3, restraining plate 48 is attached to base plate 46 and spaced parallel alignment by means of four screws 58 extending through openings 60 in restraining plate 48 and openings 62 in base plate 46. Nuts 64 are fastened to ends of screw 58 extending beyond the lower face of base plate 46. Compression springs 66 are interposed between plate 46 and 48 to surround that portion of screw 58 between plates 46 and 48. Springs 66 bias plates 46 and 48 away from one another thereby maintaining restraining plate 48 against screw heads 68 and base plate 46 against nuts 64. With screw of equal length, and provided that nuts 64 are tightened an equivalent number of threads along screw 58, springs 66 will maintain plates 46 and 48 spaced apart, in parallel alignment. By adjusting nuts 64 along screws 58, the distance between plates 46 and 48 may be varied to increase or decrease the volume of space between plates 46 and 48 to hold cigars 44 of differing diameters in each container 28.

As an optional attachment, base plate 46 may include adjustable end guides 70 adjacent each end of plate 46. Slots 72 is positioned in longitudinal alignment along base plate 46 are used as guides for screw 74 and for adjustment depending on the length of cigar to be housed between plates 46 and 48. Nuts 75 (FIG. 5) attached to the outer ends of screws 74 may be used to attach guides 70 in place. Guides 70 are oriented in spaced parallel alignment to ensure that cigars 44 are oriented and positioned properly for dispensing.

Containers 28 include an adjustable stop 76 comprising a pair of screws 78 extending through slots 80 of base plate 46. Base plate 46 includes an extension portion 82 extending beyond edge plane 84 oriented perpendicular to plate 46 which just contacts the front edge 86 of restraining plate 48. Front edge 86 is angled inwardly toward wall 40 and away from window 30 from the top to the bottom of edge 86. Bolts 88 on the upper surface of plate 46 are used to secure stops 76 in place as desired by the vending machine operator during setup as will be discussed more fully below.

Cigar dispenser 90 is positioned adjacent front edge 92 of base plate 46. Dispenser 90 includes a plurality of rearward facing fingers 94 which align with finger slots 96 of base plate 46 and finger slots 98 of restraining plate 48. Cigar dispenser 90 is connected to motor unit 100 which is activated by a signal from section 14 upon selection by the user. Unit 100 causes the rotation of dispenser 90 about its axis 101, in the direction of arrow 102. The other end 104 of dispenser 90 extends into right side wall 39 of cigar storing and dispensing section 14. Bar 106 of dispenser 90 extends longitudinally between left side wall 38 and right side wall 39 and is adjacent edge 92.

Figure 4:
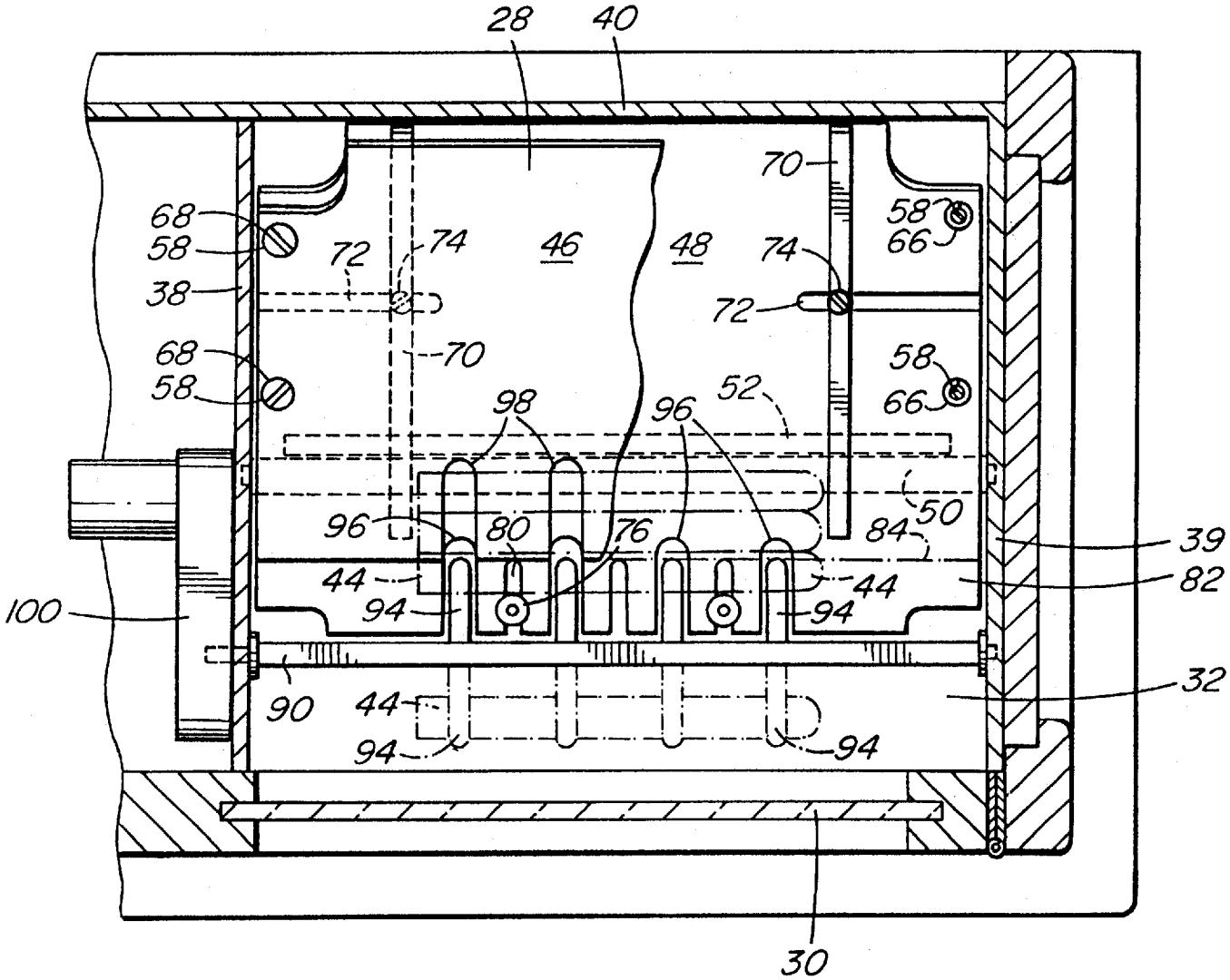
FIG. 4 is a top plan view of the container of FIG. 2.
Figure 5:
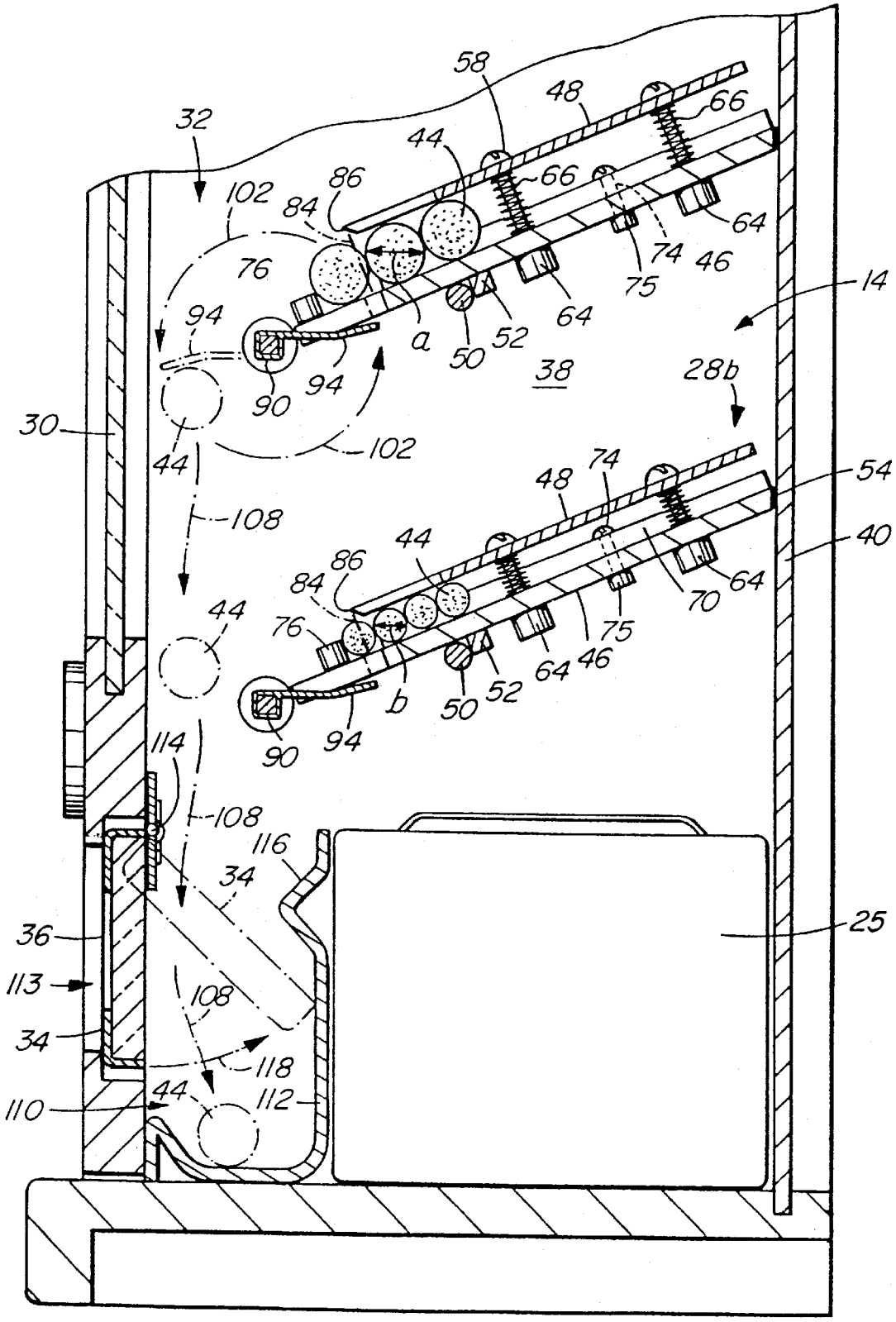
FIG. 5 is a side view of the lowest two cigar storage and dispensing containers oriented in vertical alignment, of the invention of FIG. 1.

Referring to FIG. 4, the top of one of the plurality of containers 28 is shown. Both base plate 46 and restraining plate 48 are made of transparent material such as plastic, glass or mylar material to enable users to view cigars located in container 28 as well to enable the vending machine operator to take an inventory of cigars to determine whether and to what extent refill of machine 10 is necessary. It can also be seen that fingers 94 extend almost up to but not beyond edge plane 84. Stops 76 are positioned along slots 80 the first cigar 44 adjacent window 30 is between stops 76 and plane 84. This will allow fingers 94 to lift only that first cigar upwardly and over stops 76 thereby allowing cigar 44 to fall along front open section 32 in the direction of arrows 108 (FIG. 5) to a position to be retrieved by the user.

Referring to FIG. 5, two containers 28, referred to in FIG. 5 as upper container 28*a* and lower container 28*b*, are shown in vertical alignment within section 14. Upper container 28*a* contains cigars 44 of diameter a. Lower container 28*b* contains cigars 44 of diameter b, diameter b being a smaller diameter as compared to diameter a. In other words, the cigars contained in the upper of the two containers 28*a* are larger in diameter than those contained in lower container 28*b*. Containers 28*a* and 28*b* are oriented at the same angle downwardly from wall 40 toward window 30.

Lower container 28*b*, having cigars of diameter b has had plates 46 and 48 adjusted by turning nuts 64 further along screws 58, as compared to upper container 28*a*. This reduces the volume between plates 46 and 48. As well, stops 76 are positioned closer to edge plane 84 in lower container 28*b*, as compared to upper container 28*a*. As a result, the distance between stops 76 and edge plane 84 is, in lower container 28*b*, less than that distance in upper container 28*a*. The distance between stop 76 and edge plane 84 is just slightly greater than the respective diameters *a* and *b* in upper container 28*a* and lower container 28*b*, respectively. This allows cigars 44 to pass over stop 76 and past front edge 86 when be dispensed by fingers 94 of dispenser 90 on activation by a user.

Section 14 also comprises lower cigar receiving housing 110 formed by curved rear and lower wall segment 112 and front face 113 of section 14.

Front face 113 includes door 34 hingedly attached at its top by means of hinge 114 for movement along arrow 118 in inward and opposite outward directions. Window 36 extends in a central portion of door 34 to enable users to view cigars 44 lying in housing 110 following the dispensing of that cigar from selected container 28. Door 34 may be pivoted inwardly about hinge 114 as depicted in dotted outline in FIG. 5.

Protrusion 116 extends outwardly from segment 112 at an upper portion thereof above the point of contact of door 34 with segment 112. Protrusion 116 assists in preventing users in reaching upwardly from housing 110 to obtain cigars not properly dispensed from containers 28. It can also be appreciated that door 34 blocks access to containers 28 when door 34 is in its open position when cigars are being retrieved from housing 110.

OPERATION

Referring primarily to FIGS. 1 and 5, the operation of vending machine 10 will be discussed. The user views a selection of cigars in each of containers 28 through window 30 and decides on a desired cigar for purchase. The appropriate purchase price is deposited in coin slot 16 and the code for the selected cigar is entered in keypad 20. This activates the motor unit 100 (FIG. 4) of the selected cigar's container 28 rotating fingers 94 of dispenser 90 in the direction of arrows 102. Cigar 44 is lifted by fingers 94 over stop 76 and past front edge 86 to fall in the direction of arrows 108 to the bottom of housing 110. The user then pushes open door 34 in the direction of arrow 118 and reached in housing 110 to retrieve cigar 44.

The vending machine 10 owner adjusts each container based on the diameter of the particular type of cigars to be housed and dispensed from that container. Nuts 64 are tightened or loosened about screws 58 so that cigars 44 just fit and are free to fall between plates 46 and 48 by force of gravity upon removal of the first cigar adjacent stop 76.

Stops 76 are also adjusted by the vending machine 10 operator when the machine is loaded with cigars of a particular diameter so that the distance between the inside edge of stop 76, that is the edge facing wall 40, to edge plane 84 substantially equals the diameter of the cigars to be dispensed from that container 28. Fingers 94 are dimensioned in length so that they pass rearward of stop 76 just short of edge plane 84 to ensure that only one cigar 44 is dispensed at a time and also to ensure that the next cigar 44 in line is not contacted by fingers 94 thereby preventing jamming of dispenser 90.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

I claim:

1. A vending machine for selectively dispensing cigars of varying diameter, comprising:

(a) a plurality of cigar storage and dispensing containers, each comprising:

(i) a base plate having an extension portion extending in a first direction;

(ii) a restraining plate having an edge oriented in the first direction, the restraining plate in spaced, substantially parallel relationship with the base plate, for locating a plurality of cigars of equivalent diameter between the base plate and restraining plate, the extension portion extending substantially in the first direction beyond the edge;

(iii) an adjuster for adjusting the distance between the base plate and restraining plate to conform to the diameter of the cigars to be located between the base plate and restraining plate;

(iv) an adjustable stop communicating with the extension for preventing movement of the cigars located between the base plate and restraining plate in the first direction, the stop adjustable along the plane of the base plate to change the distance between the stop and an edge plane perpendicular with the base plate and adjacent the edge of the restraining plate, to conform to the diameter of the cigar to be located adjacent the stop;

(v) cigar dispenser for moving the cigar adjacent the stop past the stop;

(b) a selector receiving an input from a user for selecting a particular cigar from one of the plurality of containers;

(c) an activator for activating the cigar dispenser of the container containing the cigar selected by the selector to move the cigar past the stop to dispense the selected cigar.

2. The vending machine as described in claim 1 wherein the restraining plate is oriented above the base plate.

3. The vending machine as described in claim 1 wherein the edge of the restraining plate is angled inwardly away from the activator from the top to the bottom of the edge.

4. The vending machine as described in claim 1 wherein the cigar dispenser comprises a finger extending from a rotatable arm, the finger contacting the cigar adjacent the stop and moving that cigar past the stop upon rotation of the rotatable arm.

5. The vending machine as described in claim 4 wherein the extension portion comprises a slot aligned with the finger located below the cigar adjacent the stop and wherein the rotatable arm rotates 180 degrees upon activation by the activator to move the cigar adjacent the stop past the stop.

6. The vending machine as described in claim 4 wherein the finger is a plurality of fingers.

7. The vending machine as described in claim 5 wherein the finger is a plurality of fingers and wherein the slot is a plurality of slots aligned with the plurality of fingers.

8. The vending machine as described in claim 7 wherein the plurality of fingers and slots is two.

9. The vending machine as described in claim 6 wherein the plurality of fingers and slots is four.

10. The vending machine as described in claim 1 wherein the adjuster maintains the restraining plate and base plate in spaced, substantially parallel alignment.

11. The vending machine as described in claim 10 wherein the adjuster comprises biasing means for biasing the base plate away from the restraining plate and a plate stop preventing further movement of the base plate and restraining plate apart from each other acting, against the force of the biasing means.

12. The vending machine as described in claim 11 wherein the biasing means comprises a spring.

13. The vending machine as described in claim 11 wherein the adjuster comprises a screw extending through aligned holes in the base plate and restraining plate and a nut secured to the screw at its end and wherein the bolt and screw head act as the plate stop, and wherein the biasing means is a spring encircling the screw between the base plate and restraining plate.

14. The vending machine as described in claim 1 wherein the plurality of cigar storage and dispensing containers are oriented at an angle and wherein the force of gravity maintains the cigars located between the base plate and restraining plate against the stop and wherein the force of gravity advances the cigars toward the stop upon the cigar adjacent to the stop being moved past the stop to dispense that cigar.

15. The vending machine as described in claim 1 further comprising a pair of opposed adjustable end plates for aligning each end of the cigars, the end plate located between the base plate and restraining plate.

16. The vending machine as described in claim 1 wherein the restraining plate is clear permitting the cigars located between the base plate and restraining plate to be viewed.

17. The vending machine as described in claim 1 wherein the stop is a plurality of stops oriented along the extension in a direction parallel with the edge.

18. The vending machine as described in claim 17 wherein the plurality is two.

19. The vending machine as described in claim 17 wherein the plurality is three.

20. The vending machine as described in claim 1 wherein the stop comprises a screw extending through a slot in the base plate, the longitudinal axis of the slot being perpendicular to the edge, and a nut attached to the screw for securing the screw and nut to the slot in the base plate.

21. The vending machine as described in claim 4 wherein the finger does not extend past the edge plane.

22. The vending machine as described in claim 1 wherein the cigar dispenser lifts the cigar over the stop to move the cigar adjacent the stop past the stop.

23. The vending machine as described in claim 14 wherein the angle of the containers to the horizontal is between 30 degrees and 45 degrees.

24. The vending machine as described in claim 23 wherein he angle is about 33 degrees.

* * * * *